United States Patent [19]

Shin et al.

[11] 3,941,523

[45] Mar. 2, 1976

[54] MULTIPLE OIL SEAL ARRANGEMENT FOR ROTARY PISTON INTERNAL COMBUSTION ENGINE

[75] Inventors: Keiichiro Shin, Ageo; Hiroshi Ozeki; Noriyuki Kurio, both of Hiroshima, all of Japan

[73] Assignee: Nippon Piston Ring Co., Ltd., Tokyo, Japan

[22] Filed: Oct. 30, 1974

[21] Appl. No.: 519,177

[30] Foreign Application Priority Data

Nov. 1, 1973 Japan ..... 48-122181

[52] U.S. Cl. ..... 418/91; 418/142; 277/59

[51] Int. Cl.[2] F01C 21/04; F01C 19/08; F04C 29/02; F04C 27/00

[58] Field of Search..... 418/91, 142; 277/59, 81 P; 123/8.01

[56] References Cited

UNITED STATES PATENTS

| | | | |
|---|---|---|---|
| 3,265,045 | 8/1966 | Bensinger et al. | 418/142 |
| 3,400,939 | 9/1968 | Jones | 418/142 |
| 3,445,058 | 5/1969 | Bensinger | 418/91 |

*Primary Examiner*—John J. Vrablik

*Attorney, Agent, or Firm*—Sughrue, Rothwell, Mion, Zinn and Macpeak

[57] ABSTRACT

A rotary piston of a rotary piston internal combustion engine has radially and inner and outer annular seals carried within grooves of the rotary piston thrust surface axially facing the engine casing sidewall with the axial end face of the oil seal tapering radially outwards relative to the engine sidewall and forming lip angles between the tapered end wall of the seal such that the lip angle for the outer seal is between 1° and 3°, the lip angle for the inner seal is between 3° and 5°, and the spring biasing force acting on the radially outer seal is less than that acting on the radially inner seal. Preferably, an oil removal bore is formed in the land portion between the grooves for return of the oil delivered thereto by action of the oil seal to the oil pan of the engine.

1 Claim, 5 Drawing Figures

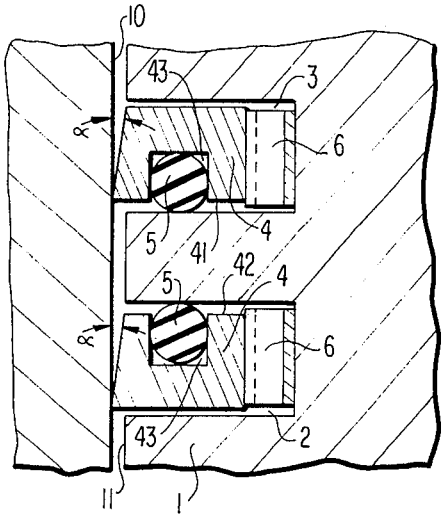
FIG. 1
PRIOR ART
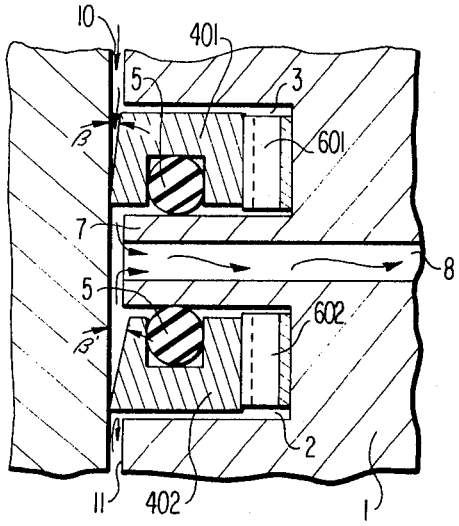
FIG. 3
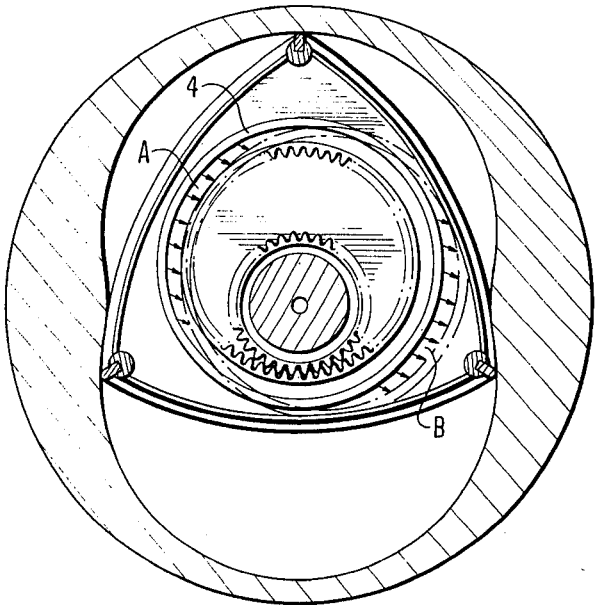
FIG. 2
FIG. 4
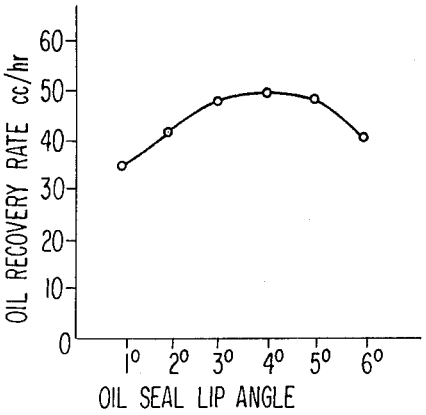
FIG. 5
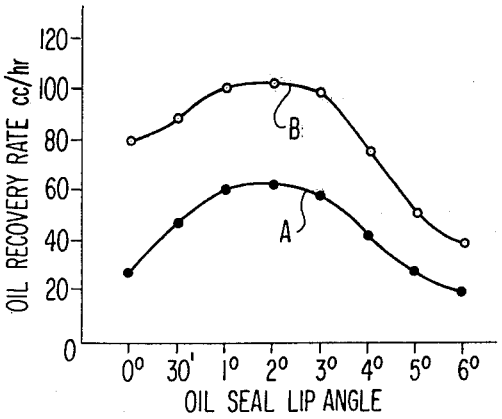

MULTIPLE OIL SEAL ARRANGEMENT FOR ROTARY PISTON INTERNAL COMBUSTION ENGINE

BACKGROUND OF THE INVENTION

1. Field of the Invention

The present invention relates to oil seal for rotary piston internal combustion engines, and more particularly to an improved dual oil seal arrangement.

Description of the Prior Art

Oil seal arrangements for rotary engines serve to prevent the oil which acts to cool the rotor and lubricate the same during its rotation relative to the fixed engine casing from leaking into the combustion chamber and to collect the surplus oil which is supplied from a metering pump and lubricate the apex and side seals, to the radial inside area thereof, for removal purposes.

In order to meet these requirements, conventionally oil seals of a dual nature as shown in FIG. 1 have been employed which comprise the formation of radially inner and outer annular oil seal grooves 2 and 3 which are formed within a thrust surface 11 of a rotor 1 which faces the fixed sidewall 10 of the rotary piston engine casing. The grooves 2 and 3 in this case carry identical annular metal oil seals 4 which are respectively provided with annular recesses 43 within their radially inner and outer surfaces 41, 42 within which are mounted O-rings 5. Springs 6 are conventionally mounted within the grooves behind the annular oil seals 4, providing a spring biasing force tending to press an axial end face of each of the annular oil seals 4 into contact with the casing sidewall 10. These axial end faces are beveled, that is, they taper away from the planar sidewall 10 and form therebetween lip angle $\alpha$ which generally are on the order of 2° and are equal for both the radially inner and outer seals.

As may be best seen by reference to FIG. 2, due to the eccentric movement of the rotor with respect to the casing, a semi-circular portion A of the oil seals 4 scrape the oil having cooled the rotor and residing on the radially inner side of the oil seals 4, to prevent the oil from leaking radially out from the oil seal. At the same time, the remaining semi-circular portion B of the oil seals 4 serve to invite the oil residing at the radially outer side of seals 4 into that portion of the gap formed between casing sidewall 10 and the lip surface or end face of the oil seals 4 with this invited oil exerting a pressure which causes the oil seal to float slightly away from the casing end wall 10 so that the oil moves to the radially inner side of each seal 4, particularly the radially outermost seal 4.

The conventional seals as at 4 which are identical in form and arrangement employ lip angles which have been selected to be on the order of two degrees so that the inside and outside oil seals perform not only an oil scraping function as the seals move radially inward with respect to the fixed casing surface 10, but each functions to invite oil to float between the end face of the seals 4 and the fixed casing wall 10 when the rotor 1 and the seals move radially outward as evidenced in FIG. 2 relative to the fixed casing. However, this value for the lip angle produces rapid wear of the lip surface and consequently a rapid increase in the contact area between the seals 4 and the sidewall 10 of the engine casing, and this leads to deterioration in the oil scraping function of the seals. This, of course, results in increased lubricating oil comsumption.

The present invention is directed to providing a solution for this problem.

SUMMARY OF THE INVENTION

The rotary piston of the present invention which rotates eccentrically relative to the engine casing and which has an axial thrust surface which faces the casing sidewall, is provided with radially inner and outer annular oil seal grooves within the thrust surface which face the casing sidewall separated by a narrow annular thrust surface land portion, each groove receives an annular metal oil seal in ring form, and the groove is provided with a spring which is positioned behind the annular oil seal and biases the oil seal axially out of the groove and into contact with the sidewall of the engine casing. The axial end face of each groove which contacts the sidewall tapers in a radially outward direction away from the sidewall to form a lip angle, the lip angle for the radially outer seal is between 1° and 3°, and that for the radially inner oil seal is between 3° and 5°. The spring biasing force acting on the radially outer oil seal is less than that for the radially inner oil seal. The land portion of the thrust surface is preferably provided with an oil removal bore for communicating the area between the grooves with the oil pan of the engine for collecting accumulated oil.

BRIEF DESCRIPTION OF THE DRAWINGS

FIG. 1 is a longitudinal, sectional view of a portion of a rotary piston internal combustion engine showing a conventional dual annular oil seal arrangement.

FIG. 2 is a transverse sectional view of the rotary engine of FIG. 1 showing the nature of operation of the dual oil seal arrangement thereof.

FIG. 3 is a longitudinal sectional view of a rotary piston internal combustion engine similar to that of FIG. 1 but incorporating the improved dual annular oil seal arrangement of the present invention.

FIG. 4 is a plot of the rate of lubricant returned to the oil pan by action of the radially inner oil seal of the present invention against the oil seal lip angle.

FIG. 5 is a plot of the rate of oil return to the oil pan by the radially outer oil seal of the present invention against oil seal lip angle with and without the oil recovery bore.

DESCRIPTION OF THE PREFERRED EMBODIMENT

Turning to FIG. 3 of the drawings, wherein like elements are given like numerical designations to the prior art arrangement of FIG. 1, the radially outer oil seal groove 3 within rotor 1 carries the radially outer oil seal in the form of an annular metal element as at 401 having a lip angle $\beta$ between 1° and 3° and is provided with an oil seal spring 601 which is mounted behind the oil seal 401 and presses the tapered axial end face of the seal against the sidewall 10 of the engine casing. The seal 401 projecting axially outwardly of the thrust surface 11 of rotor 1. On the opposite side of land 7 which constitutes a thrust surface portion intermediate of the grooves 2 and 3, the radially inner oil seal groove 2 carries an annular, radially inner oil seal 402 which in like fashion to seal 401 is of modified rectangular cross section and is provided with a tapered axial end face which defines with the planar sidewall 10. A lip angle $\beta'$ of between 3° and 5°, the oil seal 402 being likewise formed of metal and being spring biased by means of biasing spring 602 which is positioned within the groove 2 and behind the annular oil seal 402 so as to force the oil seal 402 in contact with casing sidewall 10. In similar fashion to the prior art arrangement of FIG. 1, O-rings 5 are carried within radially inner recess of oil seal 401 and radially outer recess of annular seal 402.

To the contrary of the prior art arrangement, the radially inner oil seal spring 602 exerts a biasing force on oil seal 402 which is greater than the biasing force exerted on oil seal 401 by the radially outer oil seal spring 601.

In the oil seal arrangement of the present invention, the lip angle of the radially inner oil seal is selected to be from 3° through 5°, this selection improving the oil scraping function of the radially inner oil seal 402. By experimentation, it has been proven that this range of lip angle provides maximum return of the oil to the oil pan by oil scraping operation.

During the experiment, a plurality of oil seals were manufactured, that is, radially inner oil seal 402 of different lip angles, i. et., 1°, 2°, 3°, 4°, 5° and 6°, were employed. The radially inner oil seals were incorporated in an actual engine to seek the relationship between the quantity of oil returned to the oil and the lip angles of the radially inner oil seals. The engine employed in the test and the conditions of the test were as follows:

THE ENGINE USED FOR THE TEST

| | |
|---|---|
| 1. TYPE: | Water Cooled RE Engine Having Two Rotors |
| 2. VOLUME: | 982 cc |
| 3. MAXIMUM OUTPUT POWER: | 100 PS/ 7,000 r.p.m. |
| 4. MAXIMUM TORQUE: | 13.5 Kg-m/ 3,500 r.p.m. |
| | CONDITIONS |
| 1. ENGINE SPEED AND LOAD: | 5,000 r.p.m. at Full Load |
| 2. HOURS UNDER OPERATION: | 5 hours |

The results of the test are shown in FIG. 4. Reference to that Figure shows that the amount of oil returned to the oil pan is large when the lip angle lies between 3° and 5°, and the conclusion is reached that the lip angle within the above range provides an oil return due to the excellent oil scraping function in contrast to lip angles outside of this range.

Turning next to the radially outer oil seal, the lip angle thereof is selected to be between 1° and 3° for improving oil inviting function of the radially outer oil seal as also evidenced from the test result employing the engine described above. Oil seals were manufactured for use as the radially outer oil seal having different lip angles, i.e., 0°, 30'°, 1°, 1°, 3°, 4°, 5° and 6° respectively, and the radially outer oil seals were incorporated in the same actual engine to determine the relationship between the lip angle and the quantity of oil returned to the oil pan. At the same time, tests were made to compare the rotor having the oil escaping bore at the land portion between the grooves with a rotor having no oil escaping bore, and wherein the oil between the radially inner and outer oil seals was forced to move radially inward by floating the radially inner oil seal such as seal 402. The engine employing the test and the conditions of the test were the same as the test described above providing the results illustrated in FIG. 4.

The results of these tests are shown in FIG. 5. Reference to that Figure indicates that the amount of oil returned to the oil is large when the lip angle of the radially outer oil seal 401 lies within the range of 1° to 3°. The conclusion reached is that the lip angle for the radially outer oil seal provides excellent oil inviting function over all other ranges of lip angle; in the plot of FIG. 5, the lower plot indicated at A shows the rate of removal of oil for a radially outer oil seal having various lip angles without the inclusion of bore 8. Plot B on the other hand, within the same Figure, illustrates the improvement in the rate of oil return by the combination of the oil removal bore within land 7 and a radially outer oil seal having different oil seal lip angles.

The invention is featured further by the realization that the oil seal spring for the radially inner oil seal should be stronger than that for the radially outer oil seal. Thanks to this arrangement, both the oil escaping and oil inviting functions are enhanced, that is, the function of the radially inner oil seal 402 is to scrape the oil off the engine casing sidewall 10 where it moves radially inward as indicated by the arrow, while during movement of the rotor such that oil seal 401 is moving radially outwards relative to this fixed sidewall 10, the oil tends to float the oil seal 401 against the spring bias of spring 601 which is relatively weak and a large amount of the oil is returned through bore 8 to the engine oil pan. Thus, the relatively weak oil seal spring 601 allows the radially outer oil seal 401 to be lifted from the wall 10 of the engine casing by the pressure of the oil, thereby enhancing the oil inviting function of the radially outer oil seal, whereas the relatively strong spring 602 which biases the radially inner oil seal 402 against the sidewall 10 of the engine casing answers the contact pressure thereby improving the oil scraping function of this radially inner oil seal.

As will be understood from the foregoing description, the present invention provides a dual oil seal arrangement having individual oil seals of specific lip angles and oil seal springs of different biasing force, that is, different strnegths. This specific arrangement insures that the oil having cooled the rotor is scraped from the engine sidewall 10 and prevented from leaking radially outward of the radially inner oil seal. At the same time, the oil fed from a metering pump for lubricating the apex and side seals and lying on the casing sidewall 10 is invited by the radially outer oil seal to move to the inside of that seal, where it is conveniently collected and removed through the oil escaping bore 8 formed within the land portion 7 of the rotor thrust surface 11, thereby considerably improving lubricating oil consumption. The reduced lubricating oil consumption prevents the sticking of the apex side seals which is likely to occur due to excessive supply of lubricating oil and prevents generation of harmful exhaust emissions.

Furthermore, it is noted that the lip angle of between 3° and 5° of the radially inner oil seal provides a reduced contact area between the radially inner oil seal and the sidewall 10 as compared to the conventional oil seal means in which the lip angle is typically 2°, so that the oil seal arrangement of the present invention can perform good oil scraping function insofar as oil seal 402 is concerned for a longer period of time. In addition, the oil seal spring for the radially outer oil seal which is intended only for inviting oil to flow between the oil seal and the side wall is relatively weak so that wear of the radially outer oil seal is reduced. Even an increased contact area of the outer oil seal resulting from wearing down of this member does not adversely affect the oil inviting function.

While the invention has been particularly shown and described with reference to a preferred embodiment thereof, it will be understood by those skilled in the art that various changes in form and details may be made therein without departing from the spirit and scope of the invention.

What is claimed is:

1. In a rotary piston internal combustion engine having a rotary piston mounted for rotation eccentrically about the rotor axis within an engine casing with an axial thrust surface of the rotor axially facing the engine casing sidewall, and wherein the thrust surface carries radially inner and outer annular oil seal grooves axially facing the casing sidewall and separated by a narrow, annular thrust surface land portion, and wherein each groove carries an annular metal oil seal in ring form and a spring behind the oil seal and biasing the oil seal axially out of the groove such that an axial end face of the oil seal contacts the sidewall of the engine casing, and wherein each oil seal has that axial end face tapering in a radially outward direction away from the engine casing sidewall to form a lip angle therebetween, the improvement wherein:

an oil removal bore is formed within the thrust surface land portion for removing oil accumulating between the radially inner and outer seals, the lip angle of the radially outer oil seal is between 1° and 3°, the lip angle of the radially inner oil seal is between 3° and 5°, and the spring biasing force of the spring acting on the radially outer oil seal is less than that of the spring acting on the radially inner oil seal.

* * * * *